United States Patent [19]

Howes

[11] Patent Number: 4,911,320

[45] Date of Patent: Mar. 27, 1990

[54] PRIZE HOLDING CONTAINER ASSEMBLIES

[76] Inventor: James P. Howes, 33 Cedar Rd., Wilton, Conn. 06897

[21] Appl. No.: 250,755

[22] Filed: Sep. 28, 1988

[51] Int. Cl.[4] ..... B65D 8/00; B65D 17/00; B65D 25/34; B65D 85/72

[52] U.S. Cl. ..... 220/20; 206/217; 206/457; 215/6; 215/227

[58] Field of Search ..... 206/217, 232, 457; 215/6, 227, 228; 220/20, 23, 90.4; 272/8 R, 8 N; 426/120, 124

[56] References Cited

U.S. PATENT DOCUMENTS

| | | | |
|---|---|---|---|
| Re. 17,232 | 3/1929 | Fitzgerald | 220/20 X |
| 896,540 | 8/1908 | Hetherington | 215/227 |
| 1,711,469 | 4/1929 | Stratford | 215/228 X |
| 2,287,610 | 6/1942 | Guidry | 426/120 X |
| 2,371,173 | 3/1945 | Hothersall | 220/20 |
| 2,604,976 | 7/1952 | Sarg | 426/120 X |
| 2,652,148 | 9/1953 | Pfeifer | 220/20 X |
| 2,949,369 | 8/1960 | Zoeller et al. | 426/120 |
| 2,965,496 | 12/1960 | Serdar | 220/23 X |
| 3,067,867 | 12/1962 | Bonham et al. | 220/23 X |
| 3,305,368 | 2/1967 | Bourelle | 220/20 X |
| 3,604,582 | 9/1971 | Boudin | 220/20 X |
| 3,734,276 | 5/1973 | Bank | 206/232 |
| 3,779,372 | 12/1973 | De Lloret | 220/20 X |
| 4,228,913 | 10/1980 | Mack et al. | 215/1 A X |
| 4,333,581 | 6/1982 | Flansburg | 220/20 |
| 4,478,341 | 10/1984 | Rangaswamy | 206/457 X |

FOREIGN PATENT DOCUMENTS

| | | | |
|---|---|---|---|
| 191496 | 9/1964 | Sweden | 220/20 |

*Primary Examiner*—Gerald A. Michalsky
*Attorney, Agent, or Firm*—Mattern, Ware, Stoltz & Fressola

[57] ABSTRACT

By providing prize award holding means cooperatingly associated with a container shell which is closed in the conventional manner, a container assembly is achieved for randomly distributing prize awards to consumers in association with any liquid, semi-liquid, wet or moist product, without fear of consumer detection of the prize bearing containers. In accordance with the present invention, the container assembly may incorporate the actual product along with the prize award or may comprise a simulated product container bearing the prize award without the actual product, but being completely indistinguishable from non-prize bearing, product-holding containers.

30 Claims, 7 Drawing Sheets

FIG. 3
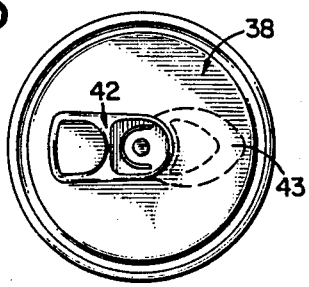
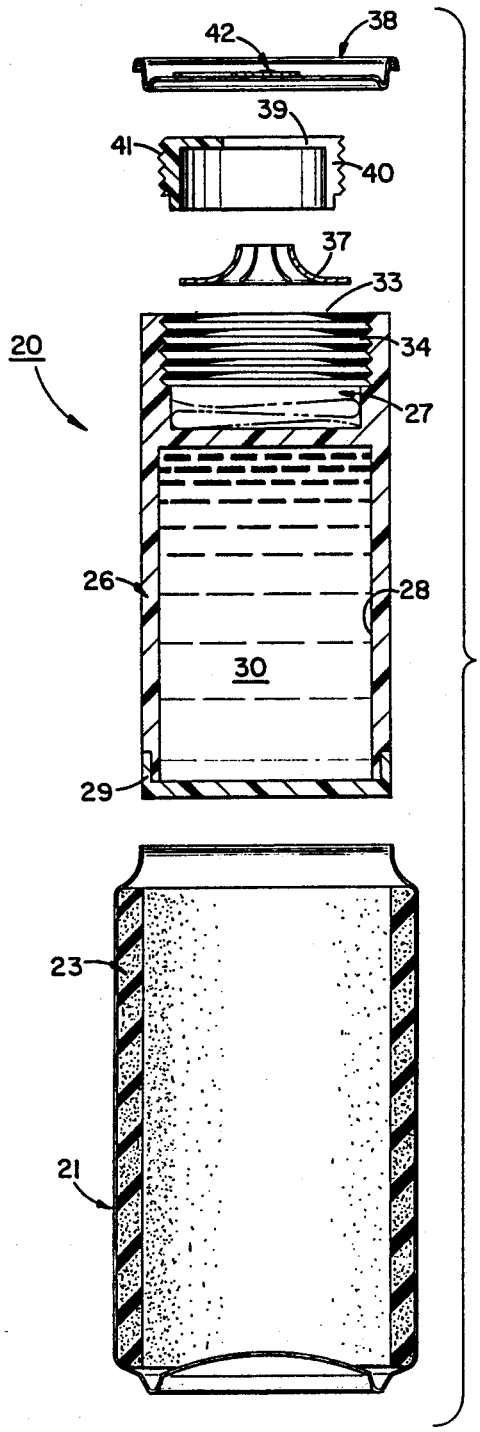
FIG. 2
FIG. 1
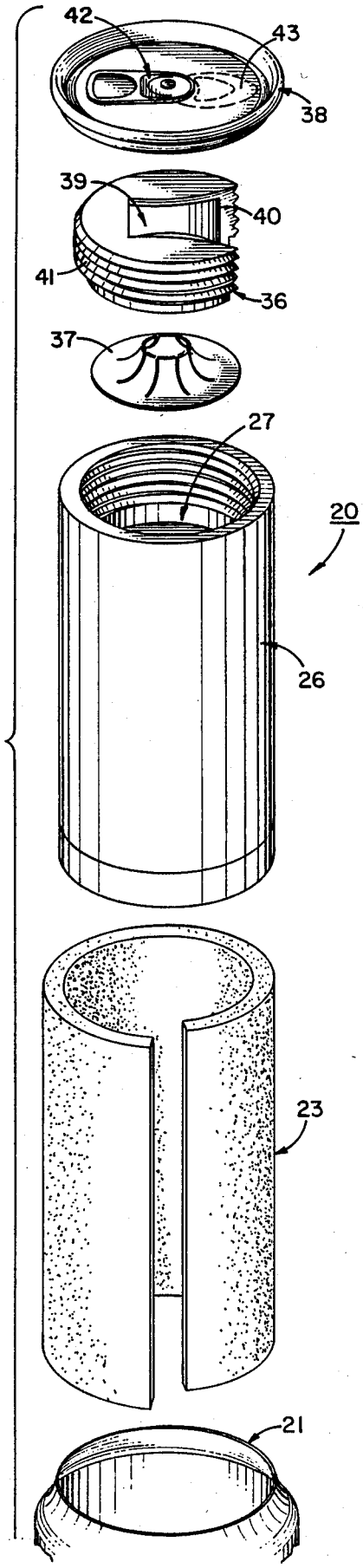

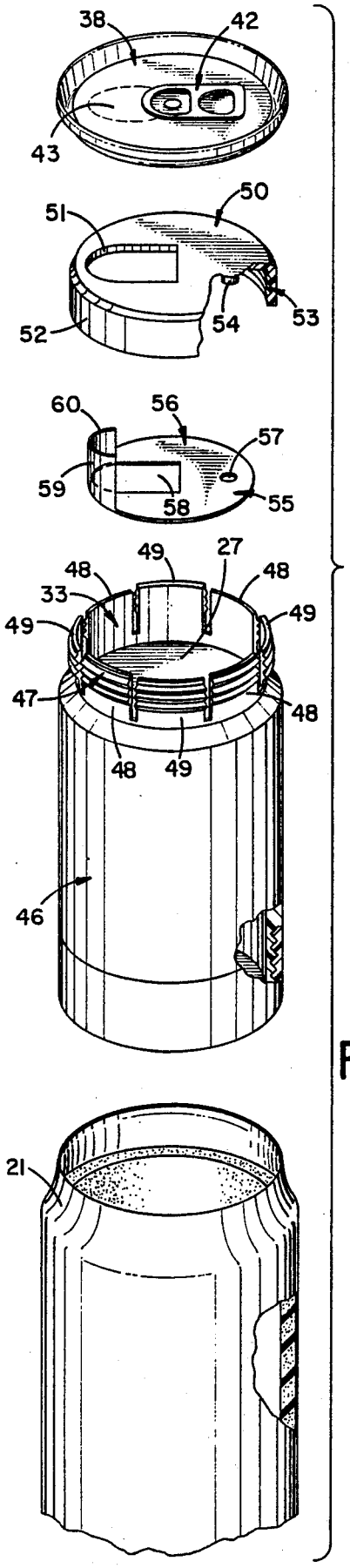
FIG. 4
FIG. 5
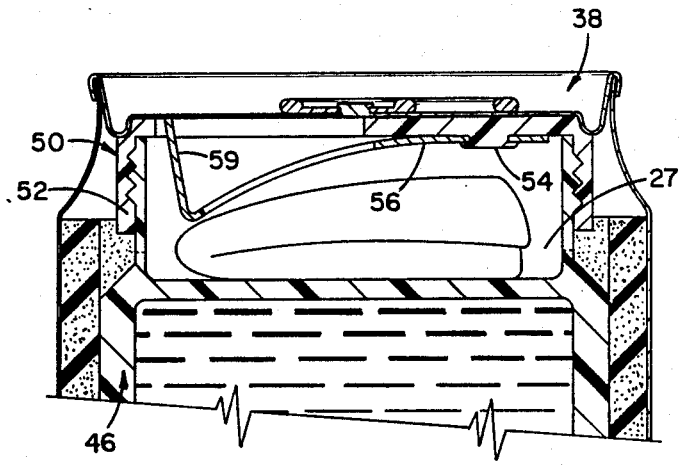
FIG. 6
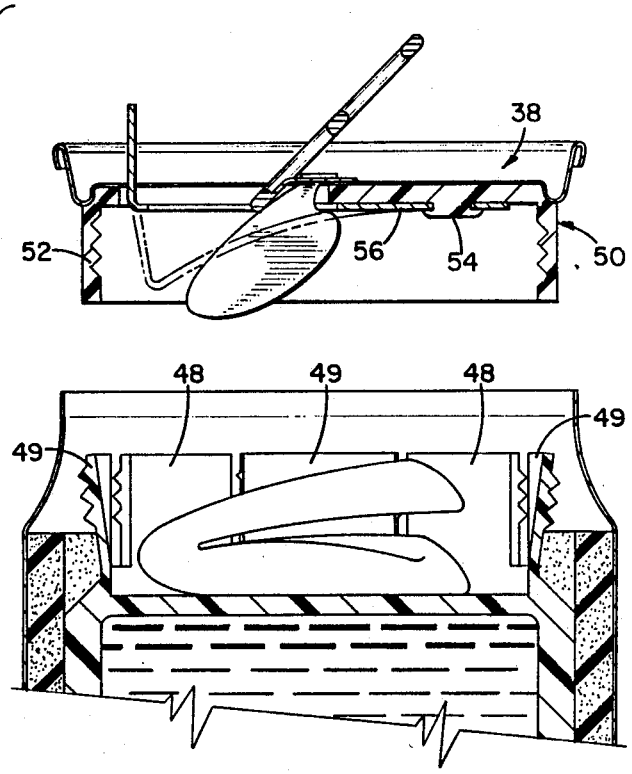

PRIZE HOLDING CONTAINER ASSEMBLIES

TECHNICAL FIELD

This invention relates to containers for liquid, semi-liquid or moist products constructed for secretly retaining a high or low value prize award and, more particularly, to simulated product containers for such goods constructed for secretly retaining a high or low value prize award while being indistinguishable from genuine product containers.

BACKGROUND ART

The use of various promotional enhancements for increasing the sales of particular products is commonly employed by manufacturers or distributors for a wide variety of products. These promotional enhancements take on a variety of forms, all for the purpose of increasing product sales.

One of the promotional methods often employed by some manufacturers is the inclusion of a prize in either every product container or in selected containers. However, prior to the present invention, this promotional concept was employable only for dry products. Generally, wet or moist products have been incapable of using this type of promotional activity due to the potential for contamination that may be caused by the presence of a foreign or non-consumable prize with the product.

In order to attain greater market share for various sales, manufacturers and distributors have found increasingly unique promotional activities in order to generate added sales for their particular products. In doing so, the premium or prize type promotion has progressed from inexpensive give-aways packed in every product bearing container to expensive prize awards which are packed in selected containers, which containers are randomly distributed with non-prize bearing containers.

Unfortunately, due principally to the difficulties of contamination, product degradation or prize degradation, such incentive programs have not been capable of being employed by manufacturers or distributors of wet or most products, particularly food products such as liquid beverages as soda, water, beer, milk, juice and the like, or moist products such as yogurt, cottage cheese, sour cream, jelly, jams, peanut butter, dips, canned fruits and vegetables, and the like. Similarly, other wet or moist consumer goods such as detergents, soaps, bleaches, automotive oils, polishes, and the like have been unable to employ this advertising technique. As a result of this inability, these manufacturers or distributors have been incapable of employing an effective product sale incentive in generating increased interest and sales of their respective products.

Consequently, it is a principal object of the present invention to provide a prize award holding container assembly for use with all liquid, semi-liquid and moist products.

Another object of the present invention is to provide a prize award holding container assembly having the characteristic features described above which forms a part of a simulated product container identical in all respects to a genuine product container, but which contains only the prize being awarded.

Another object of the present invention is to provide a simulated product container having the characteristic features described above which incorporates the outer shell of the genuine product being simulated, while comprising within the prize award as well as means to simulate both the feel and sound of the genuine product being simulated.

Another object of the present invention is to provide a prize award holding container assembly having the characteristic features described above which is virtually indistinguishable from the product bearing container being simulated and can be displayed with the product bearing containers without being detected.

Other and more specific objects will in part be obvious and will in part appear hereinafter.

SUMMARY OF THE INVENTION

By employing the present invention, the failure of the prior art to enable prize incentives or premium promotions to be used with liquid, semi-liquid, or moist products is completely overcome. In one aspect of the present invention, replicated or simulated product containers are employed to house the prize incentive, and are constructed to be identical to the genuine product container in all consumer discernable respects prior to opening the container. Only upon opening the simulated product container of this invention, the consumer is immediately informed that the consumer is a winner of the prize being awarded and is provided with instructions on how to obtain access to the prize or coupon contained in the simulated product container.

Since the simulated product container is virtually indistinguishable from the genuine product container by the consumer's external analysis, prize bearing containers can be randomly distributed with genuine product containers with complete assurance that the prize bearing containers cannot be purposefully pre-selected by the consumer. Instead, the randomly distributed prize bearing containers will be similarly randomly selected by consumers who are sufficiently lucky to win the high or low value prize award.

In the preferred embodiments, locking systems are incorporated with the simulated product containers to prevent inadvertent or unwanted opening of the prize bearing container without first having the container opened in the normal fashion as if the product were to be dispensed therefrom. In this way, any consumer having won a high or low value prize, or knowing someone who has won and seeing the manner in which the simulated product container operates, is still unable to open the simulated product containers on store shelves without actually destroying the integrity of each container.

In addition to being employable with liquid, semi-liquid or moist food-type products which are manufactured for being eaten, the present invention may also be employed with other wet or moist products used for other purposes, such as liquid detergents, soaps, bleaches, washing compositions, automotive oils, lubricants, and the like. Depending upon the type of wet or moist product being sold, the unique product construction of the present invention can be employed along with the actual product or with the product being simulated, as detailed above, for any wet, moist, liquid, or semi-liquid consumer packaged product.

The invention accordingly comprises a product possessing the features, properties, the relations of components which will be exemplified in the products hereinafter described and the scope of the invention will be indicated in the claims.

DESCRIPTION OF THE DRAWINGS

For a fuller understanding of the nature of the objects of the invention, reference should be had to the following detailed description, taken in connection with the accompanying drawings in which:

FIG. 1 is an exploded perspective view of one embodiment of the container assembly of the present invention;

FIG. 2 is a partially exploded cross-sectional side elevation view of the container assembly of FIG. 1;

FIG. 3 is a top plan view of container assembly of FIG. 1;

FIG. 4 is an exploded perspective view of an alternate embodiment of a container assembly of the present invention;

FIG. 5 is a side elevation view, partially in cross-section and partially broken away, showing the container assembly of FIG. 4 fully assembled prior to opening;

FIG. 6 is a cross-sectional side elevation view, partially broken away, of the container assembly of FIG. 4, shown in its open, disengaged configuration;

DETAILED DISCLOSURE

Figure 7:
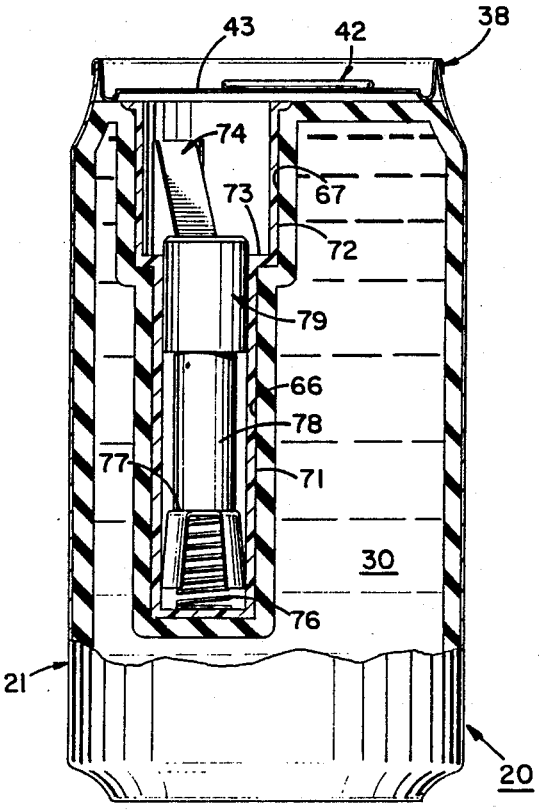
FIG. 7 is a side elevation view, partially broken away and partially in cross-section, of a further alternate embodiment of the container assembly of the present invention, shown prior to opening.

In FIGS. 1, 2, and 3, one embodiment of simulated product container 2 of the present invention is shown. In this embodiment, simulated product container 20 comprises an outer shell 2 which is in the identical form and appearance to a conventional consumable liquid holding can which container 20 is intended to simulate.

Although simulated container 20 is constructed to be identical in appearance to a conventional liquid holding can typically used for soda, beer, juices, etc., simulated product container 20 contains no consumable liquid. Instead, container 20 houses a high or low value prize. By referring to FIGS. 1, 2 and 3, along with the following detailed disclosure, the construction of this embodiment of simulated product container 20 can best be understood.

In order for simulated product container 20 of the present invention to be completely indistinguishable from the conventional liquid holding can which it is intended to simulate, simulated product container 20 must comprise not only the identical external appearance, but must also be identical to the conventional liquid holding can in both sound, weight and feel. In order to attain this virtual identity, simulated product container 20 comprises an outer can shell 21 which is identical to the can shell employed by the manufacturer or bottler of the consumable liquid for which simulated product container 20 is constructed to represent. However, instead of being filled with the consumable liquid, shell 21 contains a layer of densely packed compressible material 23 and a housing 26.

In the preferred construction, densely packed compressible material 23 peripherally surrounds the entire inside wall of shell 21. Although a variety of products can be employed for layer 23, it has been found that a layer of rubber material, densely packed foamed plastic material, blow molded, or injection molded material provides the desired inherent compressible rigidity required to effectively simulate the compression resistant forces of a conventional liquid filled can when squeezed by the consumer. As a result, any layer of compressible material which is capable of simulating the requisite compression resistance or "feel" of a conventional filled can of consumable liquid can be employed.

Directly adjacent the layer of compressible material 23 is housing 26. Preferably, housing 26 is constructed with two independent chambers, an upper chamber 27 and a lower chamber 28. As shown in FIG. 2, upper chamber 27 incorporates an enlarged entrance portal 33 and a thread-bearing sidewall 34 extending from portal 33 along the inside wall of chamber 27.

Chamber 28 preferably comprises an enlarged receiving zone into which a suitable liquid 30 is retained and sealed therein by end cap 29. End cap 29 may be secured to housing 26 in any desired manner, such as threaded engagement, friction engagement, snap lock etc. I addition, cap 29 is preferably sealed to housing 26 by conventional means, such as adhesives, sonic welding, etc., in order to prevent leakage of liquid 30 therefrom.

Liquid 30 is selected to be identical in both weight and sound to the consumable liquid for which product container 20 is constructed to simulate. In this way, when housing 26 is placed in position directly adjacent compressible material 23, a consumer selecting simulated product container 20 from a store shelf is incapable of distinguishing simulated product container 20 from the genuine liquid holding can regardless of comparisons by feel, weight or sound when the container is shaken.

The construction of this embodiment of product container 20 is completed by threaded cap 36, message disc 37, and container lid 38, which is securely affixed o cap 36. In this construction, cap 36 comprises an open portal 39 and a substantially circular, depending side wall 40 which incorporates cooperating thread means 41 formed in the outer surface thereof. Thread means 41 are constructed for mating interengagement with the thread means formed on inside wall 34 of chamber 27. Furthermore, container lid 38 is securely affixed to the top surface of thread cap 36, preferably by adhesive means.

When fully assembled, cap 36 is threadedly engaged within chamber 27 in order to securely hold therein the high or low value prize forming the gift to the consumer upon opening simulated product container 20. Depending upon the desire of the product manufacturer or distributor, the high or low value gift contained in chamber 27 may comprise any high or low value item the manufacturer or distributor wishes to award. Clearly, any prize small in size, such as currency, gemstones, car keys, or jewelry, can be easily retained in chamber 27, when suitably wrapped or folded to prevent rattling when shaken. In addition, coupons awarding substantially larger items which could not be physically positioned in chamber 27 could be placed in award chamber 27.

In order to inform the consumer that the container presently in the consumer's possession is a prize-bearing container, message disc 37 is employed. In this construction, message disc 37 comprises a substantially circular shaped disc which has been die cut with a plurality of radially extending slits to form a plurality of spring loaded arms. Disc 37 is physically placed within cap 36 directly adjacent opening 39, within the recess formed in cap 36 by depending sidewall 40.

The entire assembly is completed by securely affixing lid 38 to cap 36 and then mounting cap 36 to housing 26. When in its final position, lid 38 is positioned in overlying interengagement with the top edge of can shell 21. Once completely assembled, simulated product container 20 is both visually and physically outwardly identical to the conventional liquid holding can which container 20 is intended to simulate.

In use, a consumer purchasing simulated product container 20 opens container 20 in the normal fashion using the conventional pull tab assembly 42 of lid 38. In doing so, the pre-cut end portion 43 of tab assembly 42 breaks away from lid 38, in the conventional manner, and enters recess 39 of cap 36. Simultaneously, the arms of spring loaded die cut disc 37 are depressed until end portion 43 has passed beyond the die cut arms of disc 37, causing the spring loaded die cut arms to return to their original position directly adjacent, or emerging from, opening 39. Since each die cut arm portion incorporates a winner identification message, the consumer would immediately be notified that a high or low value prize has been won and that the prize can be obtained by rotating lid 38.

Of course, a substantial advertising effort will normally be made to promote the existence of a high or low value prize in certain selected containers. By using advertisements in newspapers, magazines, television, radio, and on the containers themselves, consumers will beinformed about the promotion and that some lucky winners will be opening containers having the high or low value prize or prizes. Consequently, consumers will be looking for the winner identification message when opening the container.

Since lid 38 and threaded cap 36 are securely affixed to each other, the rotation of lid 38 causes cap 36 to rotate simultaneously therewith, thereby threadedly disengaging cap 36 from chamber 27. Once cap 36 has been removed, a consumer can quickly and easily gain access to the high or low value prize contained in chamber 27. In addition to the high or low value prize, a coupon would also typically be incorporated therein for replacement of the beverage can which the consumer had purchased.

If desired, locking means is incorporated into simulated product container 20 in order to thwart anyone with knowledge of the rotational opening of simulated product container 20 from gaining access to container 20. Of course, a plurality of alternate constructions can be employed in order to provide a suitable rotation preventing, lock system.

One such method would be to incorporate a frangible wedge between cap 36 and thread 34, positioned within portal 39. In this way, the frangible wedge would extend from cap 26 into threaded portion 34 of housing 36 to prevent the rotation of cap 36. However, whenever the simulated product container is properly opened, the pre-cut edge portion 43 of tab assembly 42 would enter portal 39, breaking the frangible wedge member. Once broken, the consumer would be able to rotate lid 38 and cap 36 in accordance with the instructions provided. Of course, if desired, any alternate lock configuration can be employed in order to attain the same results without departing from the scope of this invention.

In FIGS. 4, 5 and 6, an alternate embodiment of simulated product container 20 of the present invention is shown. In this embodiment, simulated product container 20 is constructed substantially identically to the container detailed above and shown in FIGS. 1, 2, and 3. However, in this embodiment, an alternate housing 46, cap 50 and disc 56 are employed.

As clearly shown in FIGS. 4, 5, and 6, housing 46 incorporates an upper chamber 27 and a lower chamber 28 with lower chamber 28 completely filled with liquid 30 and sealed by end cap 29, in a manner substantially identical to housing 26. However, in this construction, upper chamber 27 incorporates an enlarged entrance portal 33 which is defined by upstanding peripherally surrounding wall 47. In this embodiment, upstanding wall 47 incorporates thread means formed about the outside surface thereof.

Furthermore, upstanding wall portion 47 is defined by a plurality of independent, non-movable segments 48, and a plurality of independent, spring biased segments 49, which move outwardly when in an unloaded configuration. As will be more fully detailed below, this construction causes spring biased segments 49 forming upstanding wall 47 to form a larger diameter whenever cap 50 is removed therefrom, as shown in FIG. 6.

Cap 50 incorporates a portal opening 51 depending, peripherally surrounding side wall 52 with thread means 53 formed in the inside surface thereof. Furthermore, cap 50 incorporates a disc holding boss 54 extending from the inside surface thereof.

In this embodiment, message disc 56 comprises a substantially flat, flexible, thin plate 55 which incorporates a boss receiving hole 57 and an entrance portal 58 formed therein. In addition, a message bearing tab 59 extends substantially perpendicularly from plate 55, directly adjacent portal 58. By employing this construction, the winner identification message bearing tab 59 is prominently displayed to the consumer in a direct error-free manner.

In operation, this embodiment of simulated product container 20 operates in a substantially identical manner to the container previously detailed. In particular, lid 38 is securely affixed to the top surface of cap 50 in order to assure that the rotation of lid 38 also causes the rotation of cap 50. Whenever a prize-bearing container is in the consumer's possession, the consumer would employ conventional pull tab assembly 42 of lid 38, as previously described. In doing so, the pre-cut end portion 43 breaks away from lid 38 and enters recess 51 of lid 50 and portal 58 of disc 56

As best seen i FIG. 5, when fully assembled, message disc 56 is securely affixed to cap 50 within the zone formed by depending side wall 52. In order to assure that disc 56 is in the precisely desired position, portal 58 of disc 56 is aligned with portal 51 of cap 50 and securely held in this fixed position by the interengagement and alignment of boss 54 within hole 57. Once in their proper position, boss 54 is sonicly welded or softened in the conventional manner well known in the art to securely affix disc 56 thereto.

When message disc 56 is secured in position and lid 38 is securely affixed to cap 50, plate 55 of disc 56 arcuately bends, with edge 60 of upstanding winner identification message tab 59 being held in contact directly below lid 38 by pre-cut end portion 43. This position is retained until the container is opened by the consumer.

Since plate 55 of disc 56 comprises a thin, flexible configuration, the positioning and securement of upstanding winner identification message tab 59 causes the entire disc 56 to be bent inwardly into chamber 27, placing spring forces upon the entire disc assembly. Consequently, when pull tab assembly 42 of lid 38 is activated and pre-cut end portion 43 is broken from lid 38 and enters portal 51 of cap 50, the spring forces of disc 56 cause winner identification message tab 59 to move upwardly out of its retained position to an upstanding, clearly visible position, protruding through the hole formed by the removal of end portion 43. I this way, the consumer is immediately identified of the existence of a high or low value prize within the simulated product container along with instructions on accessing the prize.

As detailed above in regard to the earlier embodiment, the consumer accesses prize retaining chamber 27 by rotating lid 38 which also causes cap 50 to rotate therewith. This simultaneous rotation of lid 38 and cap 50 causes cap 50 to be threadedly disengaged from the thread means on upstanding wall 47 and, when cap 50 is removed, access to chamber 27 through portal 3 is easily attained.

Furthermore, as detailed above, the plurality of spring biased segments 49 forming upstanding wall 47 are now allowed to move outwardly, since the retaining force of cap 50 has been removed. As shown in FIG. 6, this outward movement prevents anyone rom attempting to reattach cap 50 to container 46 once the prize has been removed. As a result, no subsequent use of the simulated product container 20 of the invention can be effectuated.

In FIGS. 4 and 6, the spring biased segments 49 are shown as alternating with non-biased segments 48. However, any desired number of spring biased and non-spring biased segments can be employed, as long as re-use of the container is achieved.

Figure 9:
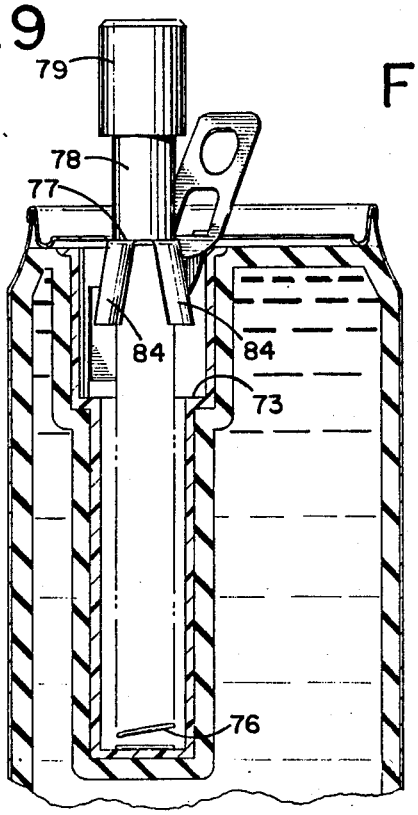
FIG. 9 is a side elevation view, partially broken away and partially in cross-section, of the container assembly of FIG. 7 shown after the container has been opened.
Figure 8:
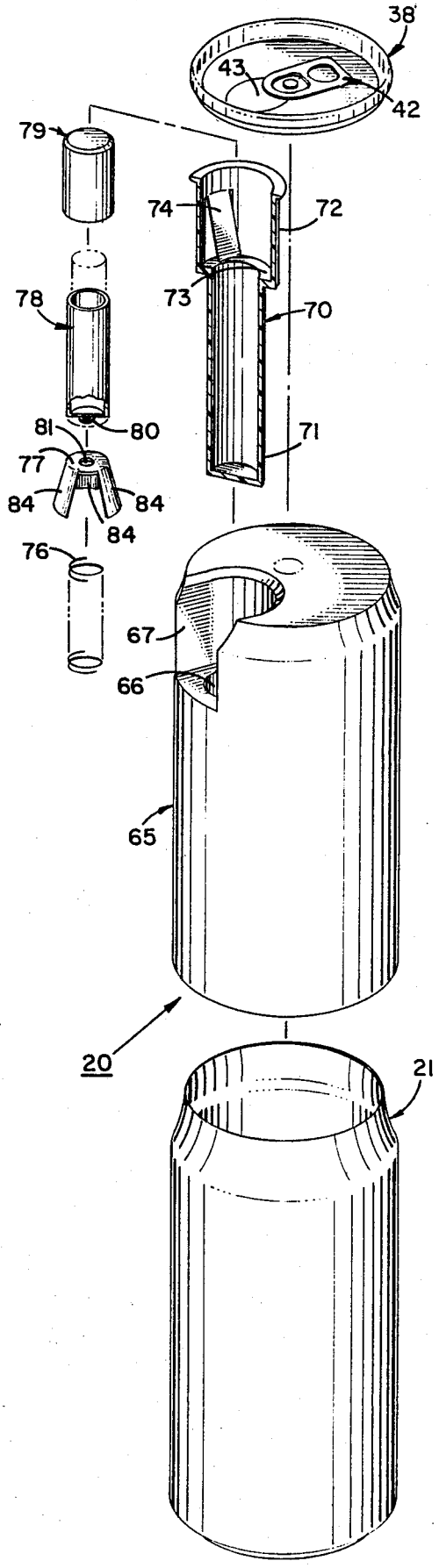
FIG. 8 is an exploded perspective view of the container assembly of FIG. 7.

In FIGS. 7, 8 and 9, an alternate embodiment for simulated product container 20 is shown in detail. In this embodiment, simulated product container 20 is constructed to completely eliminate any possibility that simulated product container 20 can be reused once the high or low value prize has been obtained by the firs consumer. As with the previous embodiments, simulated product container 20 comprises an outer shell 21 which is identical in form and appearance to the conventional consumable liquid holding can which container 20 is intended to simulate. In addition, lid 38 comprises the identical construction and configuration employed for the lid of the conventional container.

As described above with the previous embodiments, this embodiment of simulated product container 20 may also comprise a layer of densely packed compressible material 23, or lightweight blow molded material, for insertion within shell 2 to peripherally surround the entire inside wall of shell 21. However, for ease of depiction, compressible material 23 has been omitted from FIGS. 7, 8 and 9.

Directly adjacent the inside wall of shell 21, or directly adjacent compressible material 23, if employed, is housing 65. As with the previous embodiment,, housing 65 incorporates liquid 30 which is contained within housing 65 and sealingly retained therein. Liquid 30 is selected to be identical in both weight and sound to the consumable liquid for which product container 20 is constructed to simulate.

As best seen in FIG. 8, housing 65 comprises a shape substantially identical to shell 21 except for the incorporation of recessed zone 66 and cut away portion 67. Furthermore, cut-away portion 67 is cooperatingly associated and aligned with recess 66.

In addition to housing 65, this embodiment of simulated product container 20 incorporates an elongated, substantially cylindrically shaped wall-forming insert 70 which is constructed for mating interengagement and retention within recess 66 and cut-away portion 77 of housing 65.

In its preferred construction, insert 70 comprises a first elongated, substantially cylindrically shaped section 71, which is constructed for mating interengagement with recess 66, and a second substantially cylindrically shaped section 72 which is concentrically aligned with first section 71. Section 72 also comprises a movable, spring arm 74 formed in the wall thereof. As detailed below, spring arm 74 provides a movably position holding and locking arm.

At the juncture between sections 71 and 72, a substantially circular peripherally surrounding edge 73 is formed, since section 72 comprises a larger diameter than section 71. As best seen in FIG. 7, first section 71 of insert 70 is nestingly engaged with recess 66 of housing 65, while second section 72 is cooperatingly aligned with cut-away portion 67 of housing 65.

The assembly of this embodiment of simulated product container 20 is completed by spring means 76, movable base 77, prize holding vial 78 and cap 79. In the preferred embodiment, prize retaining vial 78 incorporates base securement means 80 forming the bottom portion thereof which is lockingly engaged with base 77 in cooperating recess 81. As is more fully detailed below, this secure locked interengagement prevents prize retaining vial 78 from becoming unwantingly dislodged from simulated product container 20 during its operation.

In FIG. 7, simulated product container 20 is depicted in the configuration wherein a high or low value prize is securely retained within holding vial 78 and simulated product container 20 is ready for distribution and sale to the consumer in a manner whereby simulated product container 20 is indistinguishable from the genuine product bearing can. In this configuration, as shown in FIG. 7, spring 76 is maintained under compression with base 77, prize holding vial 78 and cap 79 are secured and locked in position by movable arm 74 of upper section 72 of insert 70.

When in this locked configuration, this embodiment of product container 20 is incapable of being distinguished from the genuine beverage bearing container, particularly since all of the components are securely retained in a manner which prevents any detection by sound or feel. Furthermore, as detailed above, container 65 with liquid 30 housed therein provides assurance that simulated product container 20 provides the "feel" and sound of a genuine liquid bearing container, in addition to the identical visual appearance.

When this embodiment of simulated product container 20 is selected by the consumer and brought home for use, the consumer is quickly and immediately informed, upon opening, that a high or low value prize has been won. In order to receive this notification, a consumer merely opens simulated product container 20 in the conventional manner by pulling on tab assembly 42 of lid 38. In doing so, the pre-cut end portion 43 breaks away from lid 38 in the conventional manner, and enters upper section 72 of insert 70. As end portion 43 foldingly moves in its normal, conventional manner, end portion 43 contacts spring arm 74 and forces arm 74 out of holding engagement with cap 79. Once this holding force has been removed, cap 79, prize holding vial 78, and base 77 are all moved vertically upwardly through insert 70 by spring means 76, until the position shown in FIG. 9 has been reached.

Preferably, the top surface of cap 79 incorporates a message informing the consumer that a high or low value prize has been won and can be obtained by removing cap 79. Upon removal of cap 79, the prize can be readily accessed and removed from vial 78. Although any particular prize can be employed, either currency or a coupon is most conveniently rolled and/or folded for secure retention in vial 78.

In view of the rapid movement of prize holding vial 78 due to the spring force of spring means 76, vial 78, as detailed above, is preferably securely affixed to base 77 to prevent vial 78 from being propelled out of simulated product container 20 upon reaching the opening in lid 38. Consequently, by securely affixing vial 7 to base 77, any possibility that vial 78 can be dislodged is completely eliminated.

Furthermore, in order to assure that simulated product container 20 is not reused, base 77 is constructed with a plurality of depending legs 84 extending therefrom. In addition, legs 84 are spring biased to move outwardly upon entering upper zone 72 of insert 70. As a result, as clearly shown in FIG. 9, legs 84 move outwardly into securely affixed, locked engagement with ledge 73 when prize holding vial 78 has reached the opening in lid 38. As a result, the assembly cannot be reused or re-employed in any manner by the consumer after the consumer has obtained the high or low value prize originally provided by the manufacturer.

Figure 10:
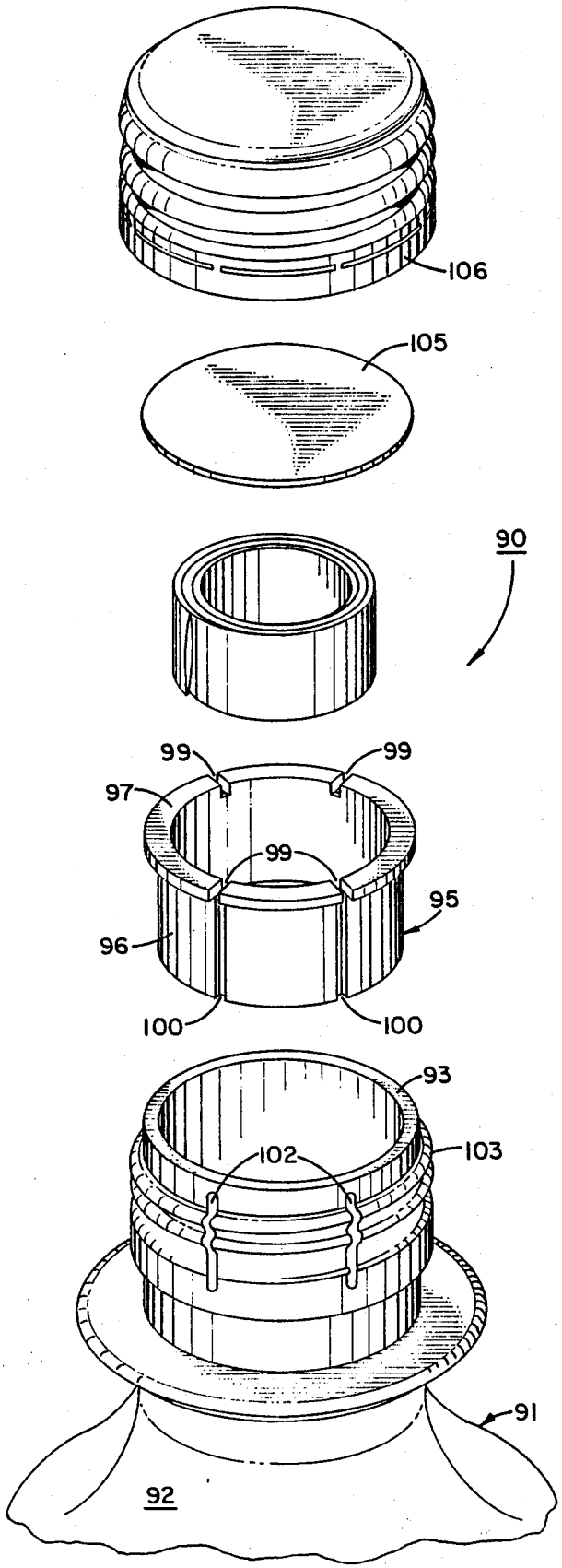
FIG. 10 is an exploded perspective view, partially broken away, of a still further alternate embodiment of the container assembly of the present invention.
Figure 12:
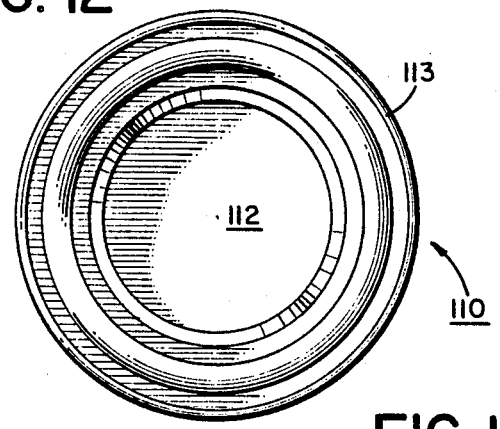
FIG. 12 is a top plan view of the container assembly of FIG. 11.
Figure 14:
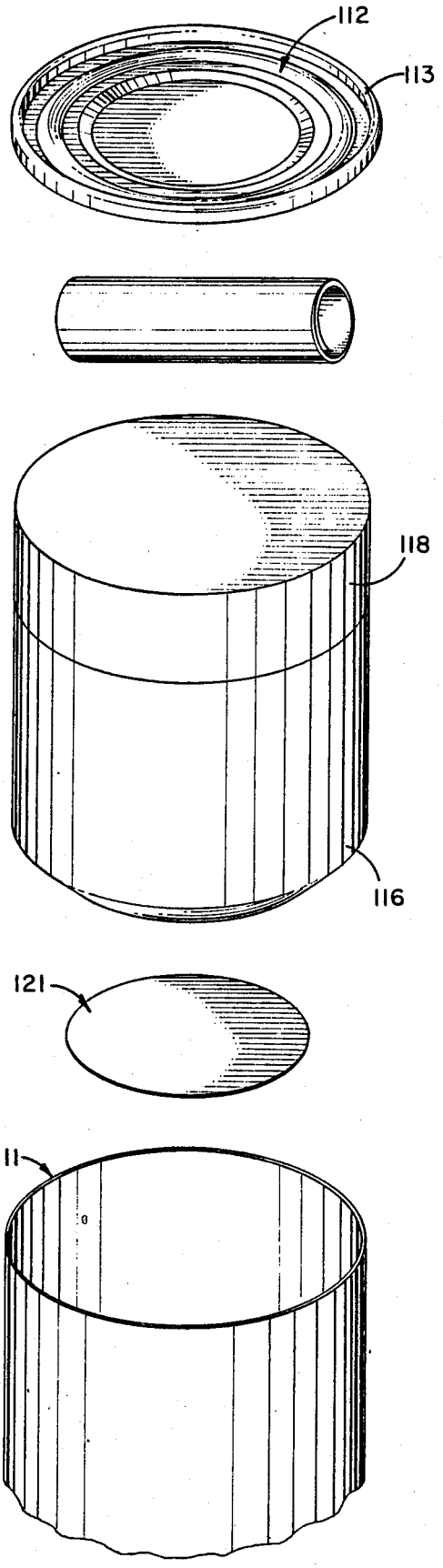
FIG. 14 is an exploded perspective view, partially broken away of the embodiment of the container assembly of the present invention shown in FIG. 11.

In FIG. 10, an alternate embodiment for prize bearing container 90 is depicted in detail. As with the embodiments discussed above, container 90 is constructed for being employed with liquids to be distributed in plastic or glass bottles. Typically liquid bearing bottles are employed for beverages, such as soda, juices, water and the like as well as numerous other non-edible products, such as detergents, bleaches, automotive oils, additives, anti-freeze compositions, and the like. Regardless of the product being distributed, this embodiment can be used with all liquid products sold in bottles. In addition opaque or transparent bottles can employ this invention with equal efficacy. However, for exemplary purposes only, and not intending any limitation thereby, a transparent consumable beverage bottle is sown in FIG. 10, since this bottle and product is the most challenging.

Prize bearing container 90 comprises an actual beverage holding bottle 91 with the particularly desired beverage 92 retained therein. In this way, the consumer purchasing prize bearing container 90 obtains the beverage purchased, as well as the high or low value prize secretly retained therewith by employing the prize holding assembly of this invention.

As shown in FIG. 10, the high or low value prize is contained in holder 95 which is constructed to fit directly into mouth 93 of bottle 91. Holder 95 comprises substantially cylindrically shaped cup member 96 terminating at its upper end with rim 97, which comprises a diameter greater than the diameter of cup member 96. In this way, cup member 96 of holder 95 fits snugly inside the mouth 93 of bottle 91, with the holder retained in position directly adjacent the entrance to mouth 93 of bottle 91 by the engagement of rim 97 of holder 95 with the top edge 98 of bottle 91.

In the preferred configuration, holder 95 also incorporates a plurality of through holes 99 formed in rim 97, which are cooperatingly aligned and connected to channels 100 formed in the outside wall surface of cup member 96. In this way, pressure build up caused by the carbonated gases within beverage 92 can easily escape during the opening process.

In conventional bottle constructions, vertical notches 102 are formed in thread means 103 of bottle 91. When the bottle seal is broken, the pressure build up is released through mouth 93, around top edge 98 and through vertical notches 102.

Since holder 95 of this invention closes off this normal flow path, holder 95 incorporates channels 100 and apertures 99. As a result, the gases are allowed to escape from inside bottle 91 by traveling through apertures 99 to vertical notches 102 for venting to the atmosphere. In this way, the normal escape of built-up gas pressure can be safely vented in the manner substantially achieved presently with such bottles.

The particular high or low value prize to be awarded would be inserted within holder 95 and retained therein by overlying disc 105. Preferably, disc 105 would incorporate a winner notification message informing the consumer that a high or low value prize has been won and can be accessed by removing disc 105. Once removed, the high or low value prize contained in holder 95 can be easily accessed.

In FIG. 10, the high or low value prize is shown as a high denomination currency bill rolled in compact form t fit within holder 95. However, as detailed above, the highor low value prize could be a coupon for an item which cannot be retained in holder 95, or alternatively, can be another high or low value prize such as gold or gems.

Finally, the assembly of prize bearing container 90 is completed by employing the standard screw cap 106 which is sealed in position in the normal manner presently employed in this industry. In view of the dimensions employed for holder 95, the thread engaging portion of screw cap 106 completely covers holder 95 from view, thereby preventing a consumer from being able to detect the presence of holder 95.

In addition, in order to further eliminate any possibility that holder 95 can be detected by visual inspection of prize bearing container 90, the entire outer peripheral surface of holder 95 comprises a metalized or mirrored surface. In this way, holder 95, when mounted in position within mouth 93 of bottle 91 will reflect the surrounding surfaces of container 91 or the appearance of the beverage 92 contained therein. Consequently, regardless of the manner in which prize bearing container 90 were to be tilted for viewing, the mirrored, polished or metalized surface of holder 95 would reflect its surrounding environment, thereby preventing any possibility that the presence of container 95 could be detected. In this way, the prize bearing container 90 can be randomly distributed on the shelf with non-prize bearing product containers so that lucky consumers randomly selecting prize bearing container 90 will receive the high or low value prize in the manner anticipated by the manufacturer or product promoter.

In FIGS. 11, 12, 13 and 14, another embodiment of the present invention is shown in the form of simulated product container 110. In this embodiment, prize container 110 is constructed to simulate wet or moist products retained in conventional "tin" or vacuum cans. Typically, these containers are use for consumer products such as soup, dog food and the like.

Simulated product container 110 comprises a substantially cylindrically shaped metal container shell 111 which is closed at both ends by lids 112, 112. Typically, both ends of simulated product container 110 are sealed in a substantially identical manner at both ends by lids 112, 112.

As with the embodiments previously described, can shell 111 comprises the identical can shell employed by the manufacturer in distributing the genuine product which container 110 is intended to simulate. Furthermore, some wet or moist products are distributed in cans wherein the side walls and bottom are formed as a single unitary shell. In such instances, the unitary shell construction would be used with one lid affixed at the open end to obtain a simulated product container in accordance with this invention.

In typical use, these vacuum cans are opened by physically cutting lid 112 internally about edge 113. As a result, simulated product container 110 is constructed to provide sufficient room to allow conventional can openers to be inserted adjacent edge 113 at either end of container 110 in order to remove lid 112 in the conventional manner.

In the preferred embodiment, simulated product container 110 comprises a housing 116 which is mounted within can shell 111 directly adjacent the inside wall thereof. Preferably, housing 116 is completely filled with a suitable liquid 117 and then sealed therein by cap 118. As with the embodiments previously detailed, liquid 117 would be selected to provide the identical weight and sound as the product which container 110 is intended to simulate. In this way, a consumer would be incapable of distinguishing between simulated product container 110 and a genuine product-bearing can container being simulated.

Figure 11:
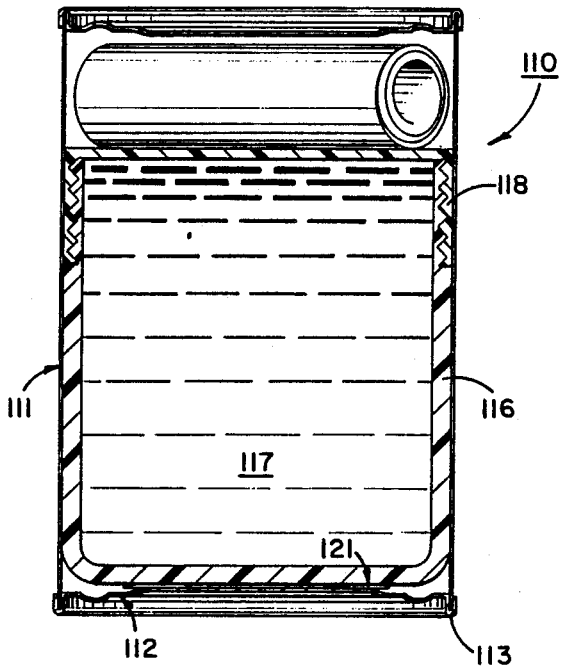
FIG. 11 is a cross-sectional side elevation view of a further embodiment of the container assembly of the present invention.

Although housing 116 may comprise a plurality of alternate configurations, the preferred embodiment is shown in FIG. 11 wherein housing 116 is constructed with an overall height less than the overall height of can shell 111. In this way, a prize retaining zone 120 is provided between cap 118 of housing 116 and upper lid 112. As shown in FIG. 10, the prize contained in simulated product container 110 is depicted as a paper roll which could be high denomination currency or a coupon redeemable for a predetermined high or low value prize. Similarly, a previously discussed, any other desired high or low value prize could be easily retained in prize holding zone 120 of container 110.

Since simulated product container 110 is constructed to be completely indistinguishable from the product which container 110 is intended to simulate, the consumer when intending to use the product thought to be purchased, would attempt to open simulated product container 110 by conventional can openers to cut off lid 112. Since, in the embodiment shown, both ends of simulated product container 110 are constructed to allow either end forming lid 112 to be removed in the normal fashion, the consumer would have no difficulty in opening simulated product container 110 in the conventional manner.

Upon opening container 110 at one end, the consumer would either immediately see the high o low value prize that has been won by gaining access to prize retaining zone 120. However, if the opposed end of container 110 were open, the consumer would be presented with a message bearing disc 121 which is secured to the bottom of housing 116.

Figure 13:
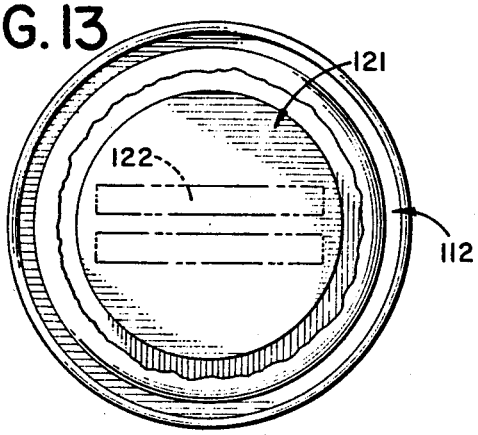
FIG. 13 is a bottom plan view, partially broken away, of the container assembly of FIG. 11.

As best seen in FIG. 13, message 122, shown in phantom, would immediately inform the consumer that they are in possession of a prize bearing container and should immediately open the other end of the container. Once the opposed end is open, the high or low value prize retained in zone 120 would be easily accessed. Of course, no message disc need be employed with the unitary cans, since only one end can be opened by the consumer.

Figure 18:
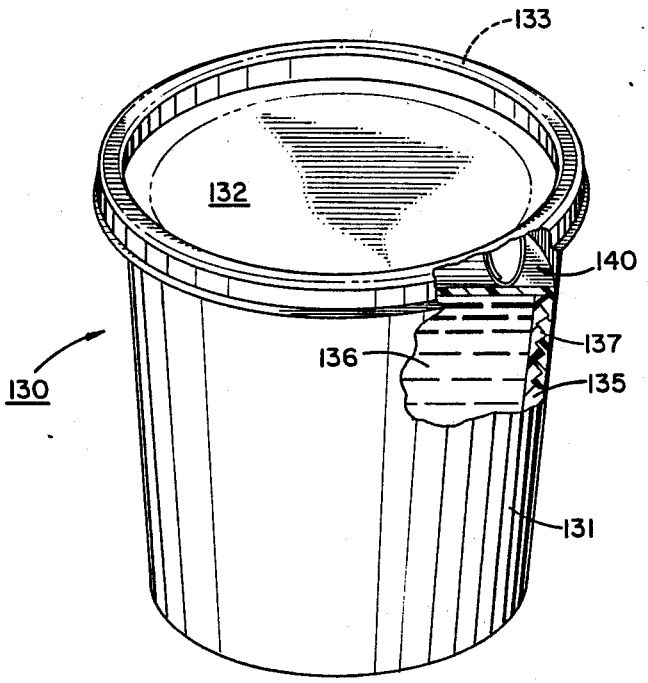
FIG. 18 is a perspective view of a further alternate embodiment of the container assembly of the present invention.

Another example of a wet or moist consumable product for which the simulated product container construction of the present invention is employed is shown in FIG. 18. In this embodiment, simulated product container 130 is depicted as a conventional cardboard or plastic container usually used for yogurt, cottage cheese, or other similar wet or moist consumable products. As with the embodiments previously detailed, simulated product container 130 comprises a genuine product container 131 and lid or cover 132. In addition, the tamper resistant sealing ring 133 employed with these products would also be mounted in its conventional position. As a result, simulated product container 130 would visually appear identical to the product which container 130 is intended to simulate.

In order to assure simulated product container 130 provides the identical "feel" and sound to a consumer as does the genuine product which container 130 is intended to simulate, product container 130 incorporates a housing 135 which is positioned within shell 131, directly adjacent the side wall thereof. Housing 135 is preferably filled with a suitable liquid 136 and then sealed by cap 137 to assure liquid 136 is securely retained therein. As with the embodiments described above, liquid 136 is selected to provide the identical weight, feel and sound upon shaking as the genuine product. In this way, simulated product container 130 is virtually indistinguishable from the genuine product which container 130 is constructed to simulate.

In this embodiment, housing 135 preferably comprises a vertical height less than the vertical height of peripherally surrounding shell 131 in order to establish a prize retaining zone 140 between cap 137 and lid 132. As shown in FIG. 18, a high or low value prize is retained in this zone for delivery to the consumer when simulated product container 130 is opened.

Since simulated product container 130 is indistinguishable from the genuine product, the consumer purchasing simulated product container 130 would assume that the genuine product had been purchased. Upon intending to use the product, the tamper resistant band 133 would be removed, and then lid 132 would be removed. Once lid 132 had been removed, the consumer immediately sees a high or low value prize contained within zone 140 and then, for the first time, is provided with the realization that the high or low value prize has been won.

By employing any desired embodiment of the simulated product container of the present invention, any wet or moist product manufacturer or distributor can effectively conduct incentive promotions using the random distribution of a high value prize directly to the consumer, without the consumer ever knowing before opening the container that the high or low value prize is retained in the product being purchased. In this way, complete random distribution to totally anonymous purchasers can be attained, showing he highest level of integrity and honesty of product distribution to the winning consumers.

Figure 16:
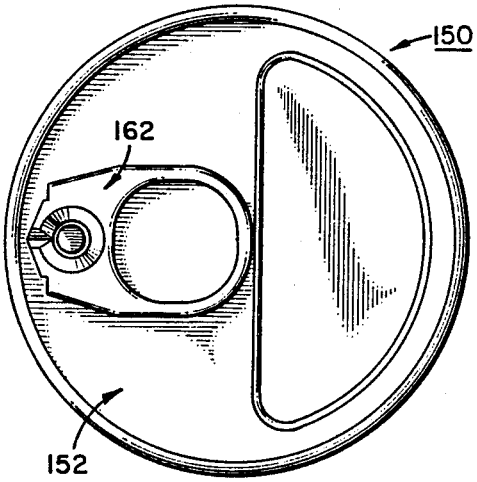
FIG. 16 is a top plan view of the container assemblyembodiment of FIG. 15.
Figure 17:
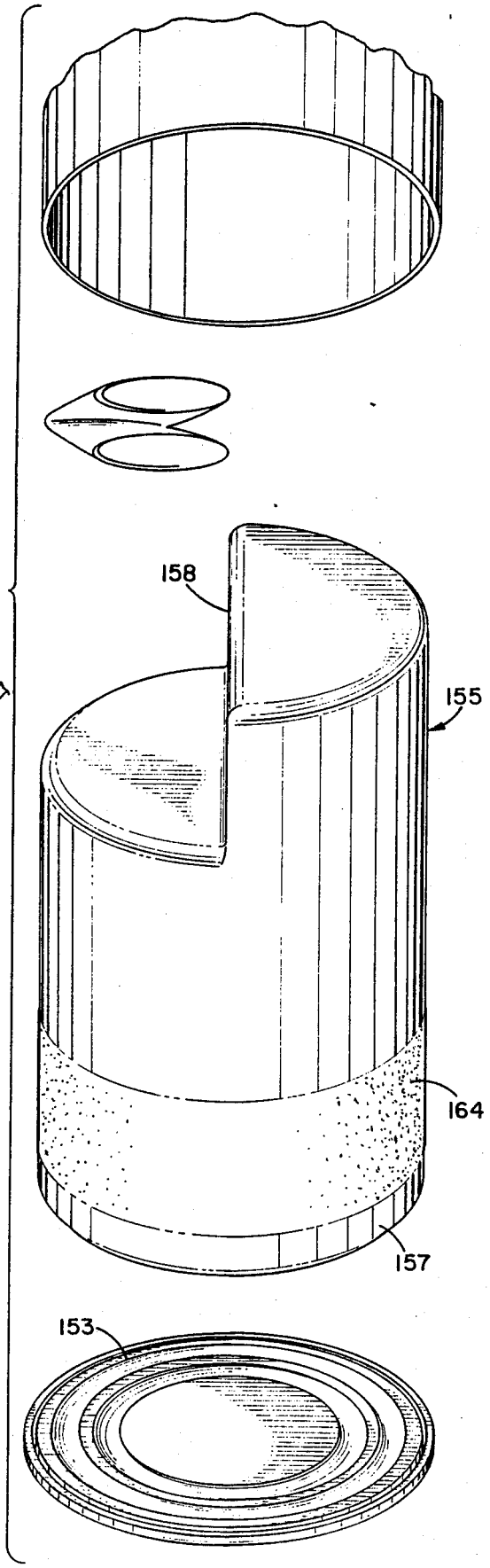
FIG. 17 is an exploded perspective view of the container assembly embodiment of FIG. 15.
Figure 15:
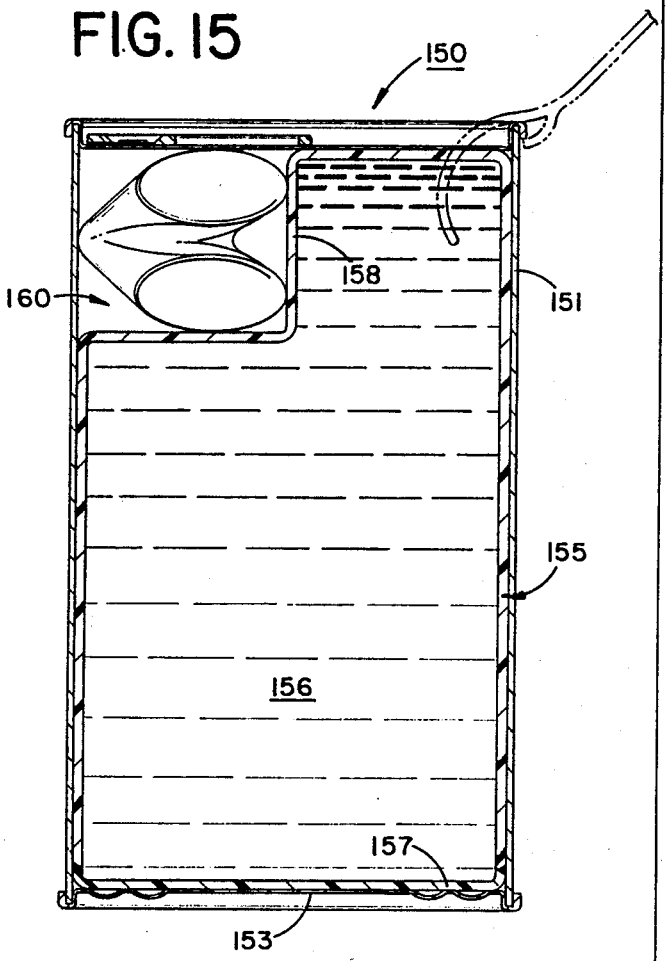
FIG. 15 is a cross-sectional side elevational view of a still further embodiment of the container assembly of the present invention.

In FIGS. 15, 16 and 17, an alternate embodiment of the present invention is shown in the form of simulated product container 150. In this embodiment, simulated product container 150 is constructed to house a high or low value prize for distribution in containers similar to containers employed for various liquid automotive products. However, any wet or moist product distributed in this type of container can employ the teaching of this invention.

Typically, these containers comprise a substantially cylindrical shell 151 which is sealed at one end by upper lid 152 and at the other end by lower lid 153. As with the previous embodiments, cylindrical shell 151 would comprise the actual cylindrical shell employed for which the product container 150 is intended to simulate. Similarly, both lids 152 and 153 would also comprise the actual lid configuration employed in the genuine product can.

Internally, however, simulated product container 150 comprises a housing 155 which is completely filled with liquid 156. Liquid 156 is sealingly retained in housing 155 by cap 157 which is affixed to housing 155.

If desired, liquid 156 may comprise simulated liquid which would provide the consumer with the "feel" and sound of the actual liquid product container 150 is intended to simulate. However, since the liquid distributed in this embodiment does not comprise a consumable liquid, the actual automotive liquid for which container 150 is intended to simulate can be sealed within housing 155. In this way, consumers would not only receive a chance of winning a high or low value prize, but would also be able to get the actual product for which container 150 had been purchased.

As shown in FIGS. 1 and 17, housing 155 is constructed with dimensions substantially identical to peripherally surrounding shell 151, except for the incorporation of a stepped wall 158 which establishes the prize retaining zone 160. As depicted, the high or low value prize may comprise a high denomination U.S. currency rolled to fit into zone 160, or a coupon redeemable for a high or low value prize.

In order to access simulated product container 150, a consumer would employ pull tab assembly 162, expecting to open a pre-cut portion of lid 152 to allow the liquid contained therein to be poured out into the consumer's automobile. However, in this embodiment, pull tab assembly 162 would be employed and would provide the consumer with access to prize retaining zone 160 so that the consumer would be able to remove the high or low value prize contained therein.

In addition, the consumer would also be instructed that housing 155 contains the product which the consumer had expected to be within simulated product container 150 and that the product can be accessed by opening housing 155 by employing conventional can openers, as depicted in FIG. 16. In this way, the consumer is able to immediately enjoy the high or low value prize which has been won as well as use the product the consumer thought was being purchased when selecting simulated product container 150 from the store shelves.

As shown in FIG. 17, if desired, housing 155 incorporates an adhesive band 164 formed about the outer peripheral surface of housing 155. Adhesive band 164 is employed in order to securely retain housing 155 in the particularly desired position relative to shell 151. Of course, adhesive band 164 is optional and would only be employed in those particular configurations where possible movement of the housing could result in potential detection of the simulated product container. However, adhesive band 164 would be employed only in those situations where required and need not be used in configurations where the housing would not be capable of movement.

It will thus be seen that the objects set forth above, among those made apparent from the preceding description, are efficient attained and, since certain changes may be made in the above products, without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

Having described my invention, what I claim as new and desire to secure by Letters Patent is:

1. A container assembly, for use in association with liquid, semi-liquid and moist products, constructed for housing a prize award and for being randomly distributed among non-prize bearing containers without being detected by the consumer prior to opening thereof, said container assembly comprising:

A. an outer surface defining container shell
   a. identical in appearance to the product bearing container shell normally employed for containing the liquid, semi-liquid or moist product;
   b. defining an internal retaining zone adjacent the inner walls thereof; and
   c. comprising at least one entry portal formed at one end thereof;

B. closure means cooperatively associated with the outer container shell for closing the entry portal thereof;

C. a housing
   a. mounted within the internal retaining zone of the container shell in cooperating relationship with the inner walls of the shell, and
   b. incorporating a first fluid retaining zone for securely holding a suitable fluid therein; and D. holding means positioned within the retaining zone in juxtaposed, spaced cooperating relationship with the entry portal for securely retaining the prize award; whereby a prize award holding container assembly for liquid, semi-liquid and moist products is achieved suitable for being randomly distributed among other, non-prize bearing, product-holding containers without fear of being detected by the consumer prior to opening thereof.

2. The container assembly defined in claim 1, wherein said fluid is further defined as comprising the liquid, semi-liquid and moist product being distributed.

3. The container assembly defined in claim 1, wherein said fluid is defined as comprising a simulated product, selected for providing the sound and weight of the actual product normally distributed in the containers.

4. The container assembly defined in claim 1, wherein said housing is further defined as comprising a second holding zone forming the holding means and retaining the prize award.

5. The container assembly defined in claim 4, wherein said prize award holding zone is further defined as incorporated an entry portal, and said entry portal is defined by a peripheral surrounding upstanding wall incorporating thread means formed on one surface thereof.

6. The container assembly defined in claim 5 and further comprising:

E. removable closure means constructed for threadingly engaging the thread means of the prize holding zone of said housing, completely closing said zone and securely retaining the prize away therein.

7. The container assembly defined in claim 6, wherein the entry portal defining wall is further defined as comprising a plurality of independent segments, with at least one of said wall segments being further defined as being movably spring biased to change the diameter of said entry portal after removal of the closure means, thereby preventing re-use of the container assembly.

8. The container assembly defined in claim 6, and further comprising a winner identification message disc associated with the closure means to provide notice to the consumer that a prize award has been won.

9. The container assembly defined in claim 8, wherein the winner identification means is further defined as:

A. comprising a substantially flat plate incorporating a message bearing tab portion extending therefrom, and B. being movable between a first spring loaded position when the container assembly is closed and a second released position when the container assembly is open, with the tab portion being in juxtaposed, spaced exposed relationship with the portal of the shell.

10. The container assembly defined in claim 6, wherein the closure means is further defined as comprising a. a substantially flat plate, and b. a depending flange peripherally surrounding said plate and incorporating the mating threaded zone formed on one surface of the flange for threadedly engaging the thread zone formed on the upstanding wall of the housing, thereby closing the holding zone.

11. The container assembly defined in claim 10, wherein said closure means is further defined as comprising c. a portal formed in the flat plate thereof and positioned for substantially vertical alignment with the entry portal of the shell, thereby assuring access to the holding zone.

12. The container assembly defined in claim 11, further comprising a message disc for informing the consumer that a prize award has been won with said message disc being cooperatively associated with the entry portal of the shell and the portal of the flat plate of the closure means for assuring the visibility of the message upon opening of the container, with said substantially flat plate of the closure means also incorporating a message disc holding boss extending therefrom and securely engaged with a receiving hole formed in the message disc to assure the positioning of the message relative to the aligned portals, thereby assuring the message will be visible upon opening of the container.

13. The container assembly defined in claim 1, and further comprising

E. flexible means positioned within the retaining zone between the inside wall of the shell and the outside wall of the housing, providing a pre-determined compressible flexibility to the shell wall for further simulating a particular product container.

14. The container assembly defined in claim 1, wherein the shell is further defined as comprising one selected from the group consisting of bottles, jars, vacuum cans, non-vacuum cans, carbonated beverage cans, containers with pull-tab openers, and containers with removable and resealable lids.

15. The container assembly defined in claim 1, wherein said holding means is further defined as being movable from a first secured position within the retaining zone to a second released position in juxtaposed, exposed relationship with the entry portal of the shell.

16. The container assembly defined in claim 15, wherein the holding means is further defined as being automatically moved from its first position to its second position by spring means, said spring means being activated only upon opening the container assembly.

17. The container assembly defined in claim 1, wherein said holding means is formed on the outer surface of the housing in spaced cooperating relationship with the shell and the entry portal.

18. The container assembly defined in claim 17, wherein said shell comprises a tin can and the entry portal comprises the lid of said can, openable by employing lid cutting means.

19. The container assembly defined in claim 18, wherein the opposed end of the can is also openable to expose the base of the housing and the container assembly further incorporates message bearing means positioned between the housing base and the adjacent lid to inform the consumer to open the opposite end to obtain the prize housed therein.

20. The container assembly defined in claim 17, wherein the entry portal of said shell is accessed by removing a pull-off lid formed thereon, providing access to the prize contained therein.

21. The container assembly defined in claim 20, wherein the fluid in the housing comprises the desired product and access to the product for use is obtained by opening the housing.

22. A simulated product container assembly, for use in associated with liquid, semi-liquid and moist products, constructed for housing a prize award and for being randomly distributed among non-prize bearing, conventional product containers without being detected by the consumer prior to opening thereof, said simulated product container assembly comprising:

A. an outer surface defining container shell a. identical in appearance to the product bearing container shell normally employed for containing the liquid, semi-liquid or moist product;
b. defining an internal retaining zone adjacent the inner walls thereof; and
c. comprising at least one entry portal formed at one end thereof;

B. closure means cooperatively associated with the outer container shell for closing the entry portal thereof;

C. a housing
a. mounted within the internal retaining zone of the container shell in cooperating relationship with the inner walls thereof, and
b. incorporating a first fluid retaining zone for securely holding a suitable fluid therein to provide the simulated product container with the sound, weight and feel of the product normally housed in the container being simulated; and D. holding means positioned with the retaining zone in juxtaposed, spaced cooperating relationship with the entry portal for securely retaining the prize award;

whereby a prize award holding container assembly for liquid, semi-liquid and moist products is achieved suitable for being randomly distributed among other, non-prize bearing, product-holding containers without fear of being detected by the consumer prior to opening thereof.

23. The simulated product container defined in claim 22, wherein the holding means is further defined as being movable from a first secured position within the retaining zone to a second released position in juxtaposed, protruding relationship with the entry portal of the shell.

24. The simulated product container defined in claim 23, and further comprising:

E. guide means
a. positioned within the retaining zone in cooperating relationship with the housing and the entry portal, and
b. constructed for defining a pathway along which said holding means travels between its two alternate positions, assuring movement of the holding means through the entry portal when said holding means moves from its first to its second position; and F. spring means positioned in cooperating relationship with the holding means and the guide means to provide automatic movement of the holding means from its first position to its second released position.

25. The simulated product container defined in claim 22, wherein said holding means is further defined as incorporating position lock means for securely latching the holding means in its second position with the holding means deployed in protruding relationship with the entry portal.

26. The simulated product container defined in claim 25, wherein said position lock means comprises at least two spring biased arms
a. mounted along the holding means and maintained in an unlatched position within the guide means when the holding means is in its first position, thereby allowing the holding means to move freely from its first position to its second position; and
b. movable laterally outwardly from the holding means when the holding means has moved into its second position, whereby said lock means securely engages the terminating edge of the guide means, latching the holding means in its second position.

27. The simulated product container defined in claim 26, wherein said housing is further defined as comprising a guide means receiving zone for matingly engaging and positioning the guide means and holding means relative thereto.

28. The simulated product container defined in claim 24, and further comprising position securing means
a. cooperatively associated with the holding means for maintaining the holding means in its first position, against the force of the spring means, and
b. cooperatively associated with the opening of the entry portal for automatically releasing the holding means, thereby allowing the holding means to automatically move from its first retained position to its second position, with a portion of the holding means extending through the entry portal, thereby presenting the prize award to the consumer.

29. The simulated product container defined in claim 28, wherein the product being simulated comprises a conventional carbonated beverage container having a lid incorporating a tab release formed thereon and said portal opening for releasing the holding means comprises the tab release mounted on the lid thereof.

30. The simulated product container assembly defined in claim 29, wherein said releasable position retaining means comprises an elongated, flexible arm positioned in contacting relationship with the holding means for maintaining the holding means in its first position, with said arm being positioned for deflection upon the pulling of the tab release formed on the container lid, with said movement causing said elongated arm to disengage from the holding means, thereby allowing the holding means to be automatically moved into its second position, with the holding means extending through the opened portal of the simulated product beverage container.

* * * * *

UNITED STATES PATENT AND TRADEMARK OFFICE

CERTIFICATE OF CORRECTION

PATENT NO. : 4,911,320

DATED : March 27, 1990

INVENTOR(S) : James P. Howes, et al

It is certified that error appears in the above-identified patent and that said Letters Patent is hereby corrected as shown below:

On the title page item [76] add --Rocco Noschese-- as an inventor

Signed and Sealed this

Sixteenth Day of July, 1991

*Attest:*

HARRY F. MANBECK, JR.

*Attesting Officer*

*Commissioner of Patents and Trademarks*